US007112751B2

(12) United States Patent
Turley

(10) Patent No.: US 7,112,751 B2
(45) Date of Patent: Sep. 26, 2006

(54) SWITCH MECHANISM FOR REVERSIBLE GRINDER

(75) Inventor: Edward M. Turley, Penticton (CA)

(73) Assignee: Turtek Technology Incorporated, Penticton (CA)

( * ) Notice: Subject to any disclaimer, the term of this patent is extended or adjusted under 35 U.S.C. 154(b) by 0 days.

(21) Appl. No.: 10/522,330

(22) PCT Filed: Feb. 17, 2003

(86) PCT No.: PCT/CA03/00236

§ 371 (c)(1),
(2), (4) Date: Jan. 25, 2005

(87) PCT Pub. No.: WO2004/015730

PCT Pub. Date: Feb. 19, 2004

(65) Prior Publication Data

US 2005/0224325 A1 Oct. 13, 2005

(30) Foreign Application Priority Data

Aug. 7, 2002 (CA) ..... 2397024

(51) Int. Cl.
*H01H 9/26* (2006.01)

(52) U.S. Cl. ..... 200/50.32; 200/332.2

(58) Field of Classification Search ..... 200/50.32, 200/50.36, 50.33, 5 B–5 D, 50.01, 50.37, 200/316–322, 332.2, 61.85
See application file for complete search history.

(56) References Cited

U.S. PATENT DOCUMENTS 3,260,827 A 7/1966 Carl
3,548,276 A 12/1970 Gross
3,564,181 A 2/1971 Chirota
3,593,084 A 7/1971 Dalton
3,611,092 A 10/1971 Wilmunder
3,710,055 A 1/1973 Blonn, Sr.
3,973,179 A 8/1976 Weber et al.
4,122,320 A 10/1978 Edgell et al.
4,259,652 A 3/1981 Mattson
4,280,026 A 7/1981 Alessio
4,342,931 A 8/1982 Grossmann et al.
4,376,240 A 3/1983 Stuart
4,588,910 A 5/1986 Bausch
4,648,464 A 3/1987 Huxley
4,879,438 A 11/1989 Winchester
5,380,971 A 1/1995 Bittel et al.
5,577,600 A 11/1996 Schoene et al.
5,600,107 A 2/1997 Tsai
5,638,945 A 6/1997 Fukinuki
5,653,296 A 8/1997 Fujiyama
5,892,885 A 4/1999 Smith et al.

(Continued)

FOREIGN PATENT DOCUMENTS

WO WO 99 46787 9/1999

*Primary Examiner*—Elvin Enad
*Assistant Examiner*—M. Fishman
(74) *Attorney, Agent, or Firm*—Paul Smith Intellectual Property Law; Paul Smith

(57) ABSTRACT

A switch mechanism for use with reversible handheld power tools comprises a pair of switches that co-operate using abutment to restrict displacement of each switch according to the position of the other switch. In a tool having a dynamic brake and a series-wound motor, one of the switches has a false neutral position wherein a continuous current path is maintained between the tool motor and the dynamic brake when the second switch is moved from REVERSE or FORWARD to the neutral position.

40 Claims, 11 Drawing Sheets

U.S. PATENT DOCUMENTS 5,969,312 A 10/1999 Svetlik et al.
6,091,035 A 7/2000 Campbell et al.
6,118,234 A 9/2000 Marcellus et al.
6,120,362 A 9/2000 Etter et al.
6,153,838 A 11/2000 Wadge
6,274,828 B1 8/2001 Chu
6,288,350 B1 9/2001 Campbell et al.
6,469,268 B1 * 10/2002 Schaeffeler et al. ..... 200/522
6,489,578 B1 * 12/2002 Jung et al. ..... 200/332.2
6,664,490 B1 * 12/2003 Kato ..... 200/449

* cited by examiner

SWITCH MECHANISM FOR REVERSIBLE GRINDER

TECHNICAL FIELD OF THE INVENTION

This invention relates to a switch mechanism for use with reversible power hand tools. More particularly, this invention relates to a switch mechanism for reversible power hand tools equipped with a dynamic brake and a series-wound motor.

BACKGROUND OF THE INVENTION

Handheld power tools tend to be small, lightweight and portable, making them useful in many situations. However, these tools can also be dangerous, in that they may continue to operate even after the user has turned it off. For example, momentum may cause the grinding wheel on a reversible grinder to rotate even after the user has released the trigger. To alleviate the problem, many power tools incorporate a dynamic brake and provide a default position for the power switch that engages the dynamic brake. Dynamic brakes typically short the motor windings through a resistor. In order to increase the amount of braking power, it is known to sometimes employ an auxiliary set of windings in series with the motor windings.

U.S. Pat. No. 5,600,107 to Tsai and U.S. Pat. No. 5,380,971 to Bittel disclose trigger mechanisms for power tools with dynamic braking systems. In both patents, depressing or squeezing the trigger moves the electrical contacts within the switch, completing a power circuit and operating the tool's motor. The triggers are spring-biased to the OFF position. Releasing the trigger causes the electrical contacts to move back to the OFF position, both breaking the motor supply circuit and completing a separate dynamic braking circuit. Thus, two sets of contacts are required to move before the dynamic brake is activated and the motor stops. Neither patent is applicable to reversible power tools.

A typical reversible power tool directional switch has FORWARD, OFF and REVERSE positions. In the OFF position, current flow through the motor windings is interrupted. However, in order for a dynamic brake to operate, a current path through the motor windings must be maintained.

U.S. Pat. No. 5,892,885 to Smith discloses a complicated dynamic braking circuit, for use with a reversible power tool. The dynamic brake is engaged by disconnecting the power source and speed control circuit, then connecting two other contacts, creating a low resistance path between the motor terminals. The means for switching the direction of operation of the motor comprises a pivoting lever that is independent of the actuating trigger. It therefore appears that it is possible, using the switch disclosed by Smith, to switch the direction of tool operation between FORWARD and REVERSE without any intermediate state, thereby presenting a significant risk to the user.

U.S. Pat. No. 5,638,945 to Fukinuki discloses a safety mechanism in the form of a lock or blocking element associated with the trigger, so as to physically prevent the trigger from moving out of position until the user does so intentionally by releasing the lock. A sliding safety switch is disposed on opposite sides of a tool handle. The safety switch consists of a generally T-shaped sliding lock button that is spring-biased to return to the locked position upon release by the user. An abutment surface extends from the trigger and physically blocks the sliding switch, preventing accidental depression of the trigger and operation of the tool.

Once the sliding switch is moved to an operational position, it no longer blocks the trigger abutment surface. When the trigger is depressed, a hooked extension at the front of the trigger engages an inversely hooked extension at the front of the sliding switch. This contact locks the tool in an operative mode by preventing the switch from sliding back to a neutral position, even if the trigger is released. Depressing the trigger again unlocks the hook, allowing the tool to shut down when the trigger is released. While the hook mechanism reduces hand fatigue by allowing the user to operate the tool without maintaining pressure on the handle, if the user accidentally drops the tool while the hook is engaged, the tool will continue to operate. This poses a significant danger to both the user and to any person or thing around him. Further, the switch mechanism disclosed by Fukinuki is unsuitable for use in a power tool with a dynamic brake, as the switch does not actively make or break an electrical contact, as is required for a dynamic braking system.

It is an object of the present invention to provide a switch mechanism that is suited for a reversible power tool having a dynamic brake. The switch arrangement according to the invention is designed to maintain a current path through the motor windings when a FORWARD, OFF and REVERSE switch is moved to the OFF position. There is also provided a safety mechanism to ensure that the dynamic brake is engaged prior to switching between the FORWARD and REVERSE positions.

The foregoing and other objects of the invention will be appreciated by reference to the summary of the invention and to the detailed description of the preferred embodiment that follow.

SUMMARY OF THE INVENTION

The switch mechanism according to one aspect of the invention includes a switch having FORWARD, OFF and REVERSE positions. The switch mechanism is mounted on a reversible power tool having a motor, a trigger and a dynamic brake. The trigger activates the motor when it is depressed and completes the dynamic brake circuit when it is released. When the switch is in the OFF position, the trigger is physically locked by the switch into the released position, corresponding to the brake mode, such that accidental pressure on the trigger cannot activate the motor. When the switch is moved to the FORWARD or REVERSE position, the trigger may be depressed to activate the motor, but the switch can not return to the OFF position until the trigger is released to engage the dynamic brake.

In the preferred embodiment, the locking mechanism between the switch and the trigger comprises an abutment between a portion of the switch and a portion of the trigger. When the switch is in the OFF position, the abutment prevents the trigger from being depressed. When the switch is moved to the FORWARD or REVERSE positions, the trigger may be depressed but abutment is thereby established between the switch and the trigger preventing movement of the switch until the trigger is released. This arrangement prevents the accidental movement of the switch to the OFF position while the trigger is depressed. It also prevents direct transiting between the FORWARD and the REVERSE positions.

The switch is biased to the OFF position by springs. Once the trigger is released, the switch automatically returns to the OFF position, locking the trigger in the released (brake) mode.

The switch is configured such that when it moves from the FORWARD or REVERSE position to the OFF position, its internal contacts maintain the FORWARD or REVERSE circuit path through the motor. This is done by establishing a "false neutral" position within the switch corresponding to the OFF position. The current path required to operate the dynamic brake is therefore maintained by the switch. As noted above, movement of the switch from the FORWARD or REVERSE position to the OFF position is also constrained, by the abutment and bias arrangement, to necessarily coincide with the release of the trigger to engage the dynamic brake. This ensures that the motor will not operate when the switch is in the OFF position, despite the switch maintaining a current path through the motor.

The false neutral position is created by a cavity within the switch that is large enough to allow the switch to travel to the OFF position, but without yet switching the internal contacts. The switch must be fully displaced in the opposite operative position, in order to change the selection of internal contacts and to establish the circuit for tool operation in the opposite direction.

In one aspect, the invention relates to a switch mechanism for use in a power tool having a motor and at least two operable directions comprising a first switch having an ON and an OFF position to selectively actuate said motor; and a second switch to select between said directions, said second switch further comprising a neutral position in which neither of said directions is selected. A first portion of said first switch is adapted to abut a first portion of said second switch when said second switch is in the neutral position and said first switch is in said OFF position; said abutment of said respective first portions preventing displacement of said first switch to said ON position until said second switch is displaced to a position other than said neutral position. Further, a second portion of said first switch is adapted to abut a second portion of said second switch when said first switch is in said ON position and said second switch is in a position other than said neutral position, said abutment of said respective second portions preventing displacement of said second switch to said neutral position until said first switch is displaced to said OFF position.

In a more specific aspect, the second switch of the invention comprises an approximately inverted-U-shaped external sliding switch, with a cavity on the uppermost underside of the external sliding switch and an internal switch.

In a more specific aspect, the internal switch may be an approximately t-shaped sliding switch, or a toggle switch. The first switch may be a trigger.

In a further aspect, the switch mechanism of the invention may comprise means to bias the external sliding switch to a centred position, said centred position corresponding to the neutral second switch position. Such biasing means may comprise one or more springs. The springs may be maintained in place by a connection to the external sliding switch. The connection may be made using one or more roll pins.

In yet a further aspect, the switch mechanism of the invention may comprise a mounting mechanism to secure the switch mechanism in place, wherein said mounting mechanism comprises end blocks of a shape and size to snugly fit into the handle of the power tool and one or more pairs of rods separating the end blocks.

In a further aspect, the switch mechanism of the invention may be installed in a power tool with a series-wound motor. Further, the power tool may also comprise a dynamic brake wherein said dynamic brake is engaged when said second switch is in said neutral position. The dynamic brake may comprise auxiliary windings in series with said series-wound motor.

In yet a further aspect, the switch mechanism may comprise at least one pair of motor contacts to allow operation of the tool in each of the operable directions.

In another aspect, the second switch of the switch mechanism may comprise an approximately inverted-U-shaped external sliding switch with a cavity on the uppermost underside of the external sliding switch, an internal switch, electrical contacts extending from the lowermost surface of the internal sliding switch, and one or more rocker contacts serving to connect the electrical contacts extending from the internal sliding switch to the motor contacts.

In a further aspect, an electric current path runs through said motor, said motor contacts, said rocker contacts and said electrical contacts when said first switch is in said ON position and said second switch is positioned to select one of said operable directions.

In yet a further aspect, an electric current path runs through said motor, said motor contacts, said rocker contacts, said electrical contacts and said dynamic brake when said first switch is in said OFF position and said second switch is in said neutral position.

In another aspect, the invention relates to a switch mechanism for use in a power tool with a motor and a dynamic brake and at least two operable directions comprising a first switch having an ON and an OFF position to selectively actuate said motor and a second switch to select between said directions, said second switch further comprising a neutral position in which said dynamic brake is engaged.

In a further aspect, the invention relates to a switch mechanism wherein said switches are constrained such that the first switch can move to the ON position only when the second switch is not in the neutral position. The switches may also be constrained such that the second switch can move to the neutral position only when the first switch is in the OFF position.

In a more specific aspect, the switches may be constrained by physical abutment of a portion of said first switch to a portion of said second switch.

In another aspect, the switch mechanism of the invention may comprise a mounting mechanism to secure the switch mechanism in place, wherein said mounting mechanism comprises end blocks of a shape and size to snugly fit into the handle of the power tool and one or more pairs of rods separating the end blocks.

The foregoing was intended as a broad summary only and was not intended to define the limits or requirements of the invention. Other aspects of the invention will be appreciated by reference to the detailed description of the preferred embodiment and to the claims.

BRIEF DESCRIPTION OF THE DRAWINGS

The preferred embodiment of the invention will be described by reference to the drawings in which.

DETAILED DESCRIPTION OF THE PREFERRED EMBODIMENT OF THE INVENTION

Figure 1:
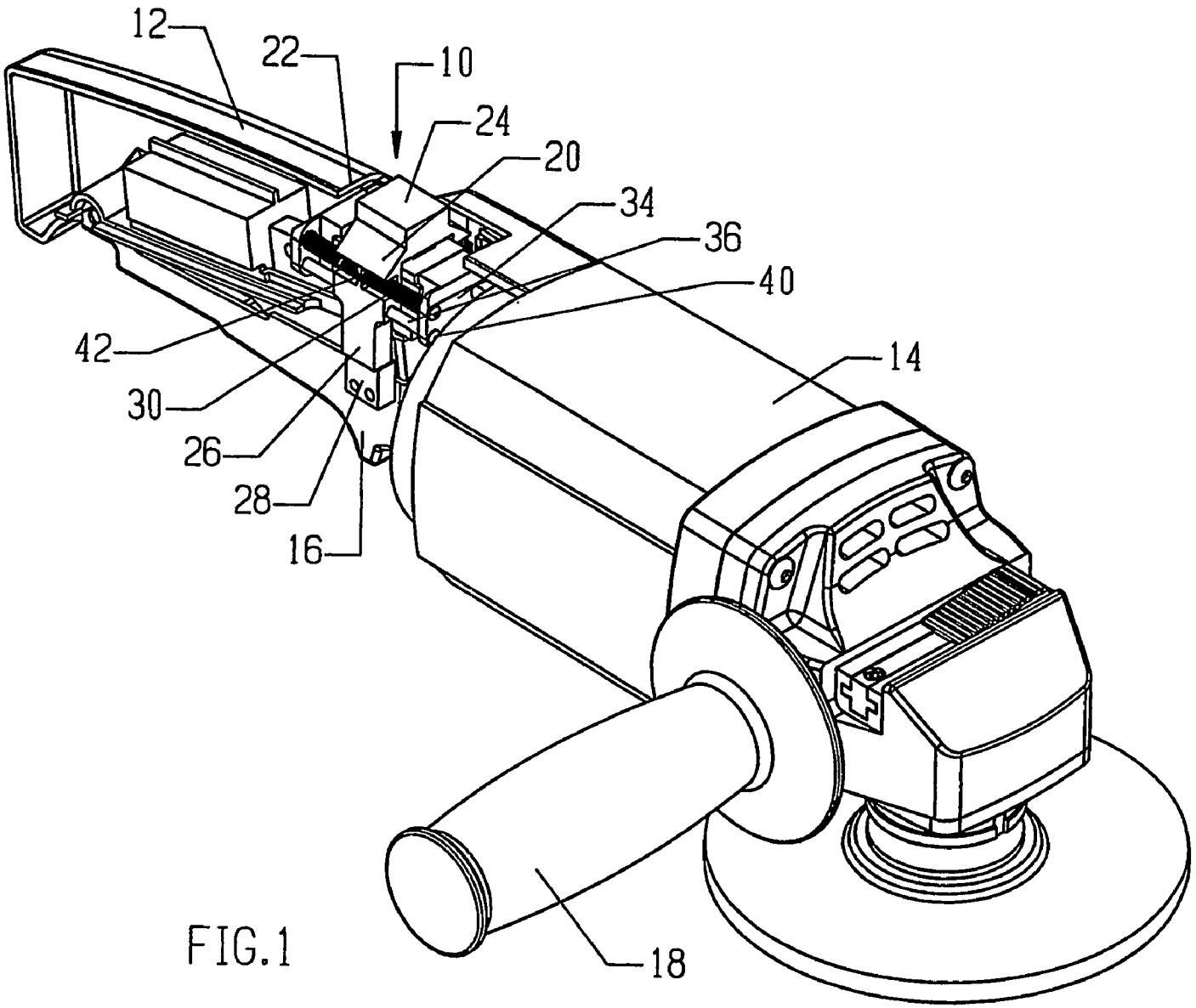
FIG. 1 is an isometric view of a reversible grinder with a portion of the grinder handle housing cut away to reveal the switch mechanism of the preferred embodiment.
Figure 2:
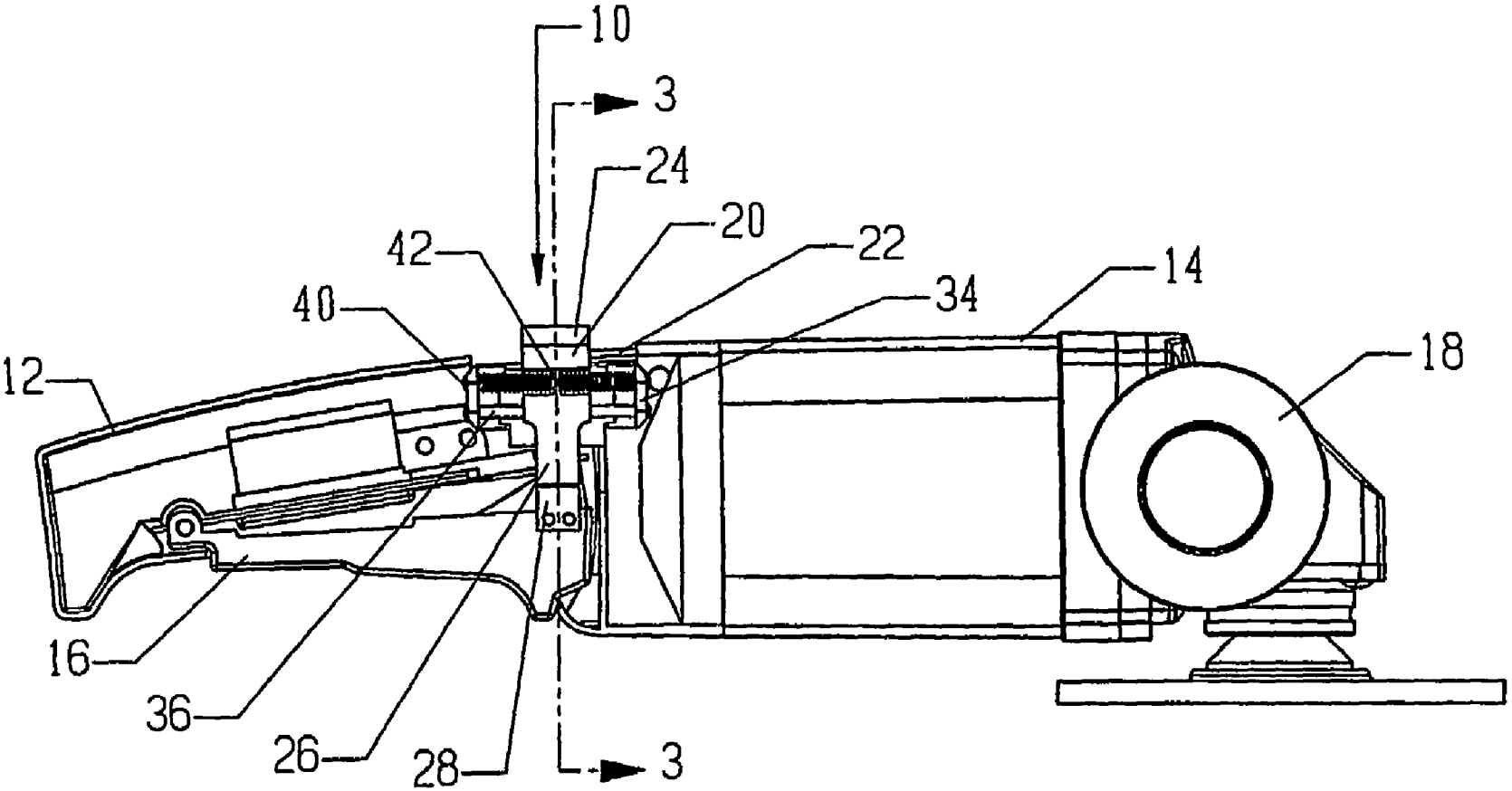
FIG. 2 is a side view of the grinder and switch mechanism of FIG. 1.

Referring to FIGS. 1 and 2, the switch mechanism 10 is shown in place in the handle 12 of a reversible handheld power tool, such as a grinder 14, operated by a series-wound motor 51 (not shown in FIGS. 1 and 2).

Figure 11:
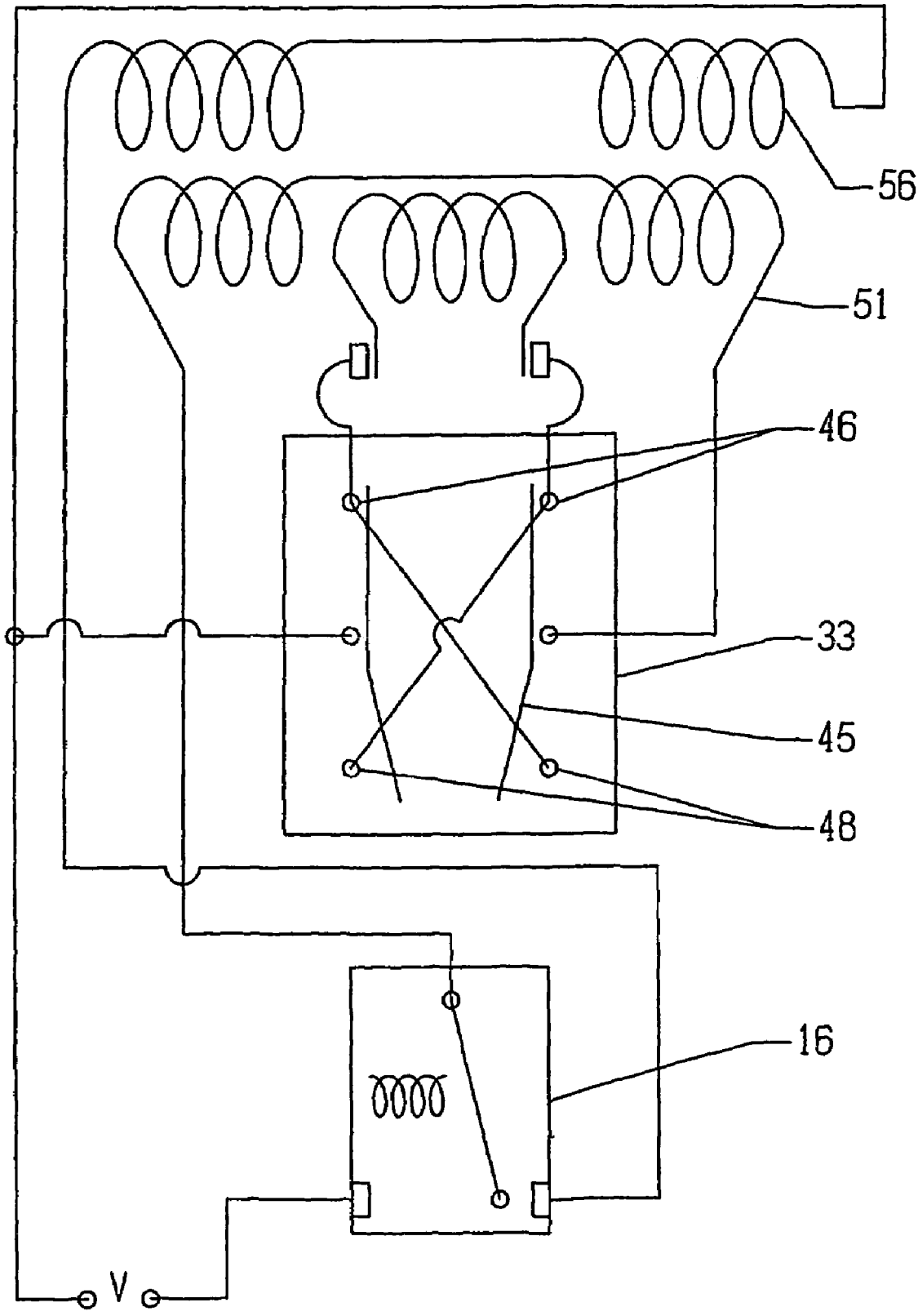

A pivoting trigger 16 is disposed in the grinder handle 12 in opposite relation to the switch mechanism 10. The positions of the trigger 16 and switch 10 in the grinder handle 12 allow one-handed operation of the trigger and switch mechanism, leaving the other hand free to control the grinder via the hand grip 18. The power tool is provided with a dynamic braking system comprising auxiliary windings 56 connected in series with the windings of the grinder's series-wound motor 51, as best shown in FIG. 11.

The switch mechanism 10 generally comprises an internal switch (not shown in FIGS. 1 and 2) inside an external switch 20. Switch 20 has FORWARD and REVERSE positions, as well as a central OFF position. Switch 20 is spring-biased to the OFF position. In the OFF position, switch 20 maintains a physical contact with the trigger 16, preventing depression of the trigger 16. In this released position, internal contacts associated with the trigger 16 switch from the power supply circuit to the dynamic brake circuit, as best appreciated by reference to FIG. 11.

The external switch 20 portion of the switch mechanism 10 protrudes through a slot 22 in the grinder handle 12. External switch 20 is shown in the drawings as a square thumb slide 24, though the exact shape and size of the external switch is unimportant. Thumb slide 24 may be covered with a larger knurled thumb pad (not shown) to allow a better grip on and hence more control over the external switch. A larger thumb pad could also completely cover the clearance slot 22, preventing dust and dirt from entering the grinder 14.

Figure 3:
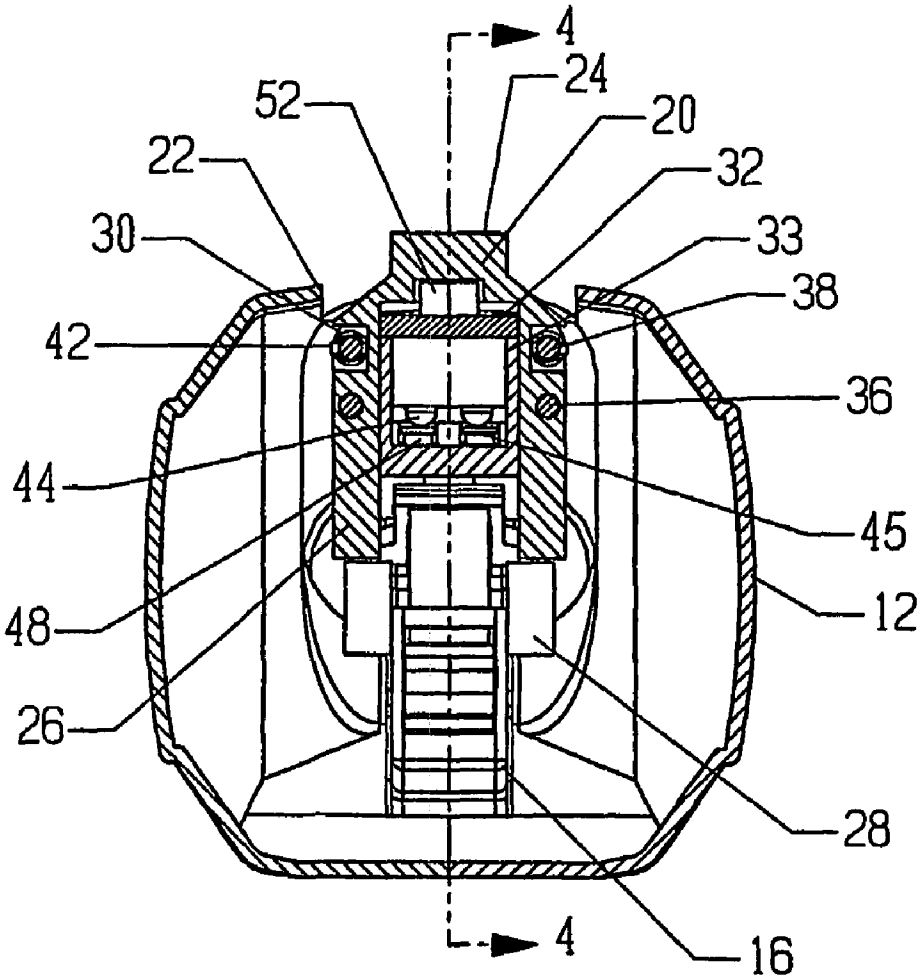
FIG. 3 is a sectional view of the switch mechanism and grinder, taken on line 3—3 of FIG. 2.

Referring now to FIGS. 1, 2 and 3, external switch 20 comprises a pair of opposed legs 26 depending from the thumb slide 24. Two safety dogs 28 extend upwardly from the trigger 16 and are positioned to directly underlie legs 26 when switch 20 is in the OFF position. The legs 26 and dogs 28 therefore abut one another when an attempt is made to depress trigger 16 while switch 20 is in the OFF position. This abutment prevents depression of the trigger 16.

Two pairs of compression springs 30 bias the external switch 20 to the OFF position. If the user sets external switch 20 to FORWARD or REVERSE, but without depressing the trigger 16, the external switch 20 returns to the OFF position, maintaining the dynamic brake circuit and preventing accidental operation of the grinder.

Figure 4:
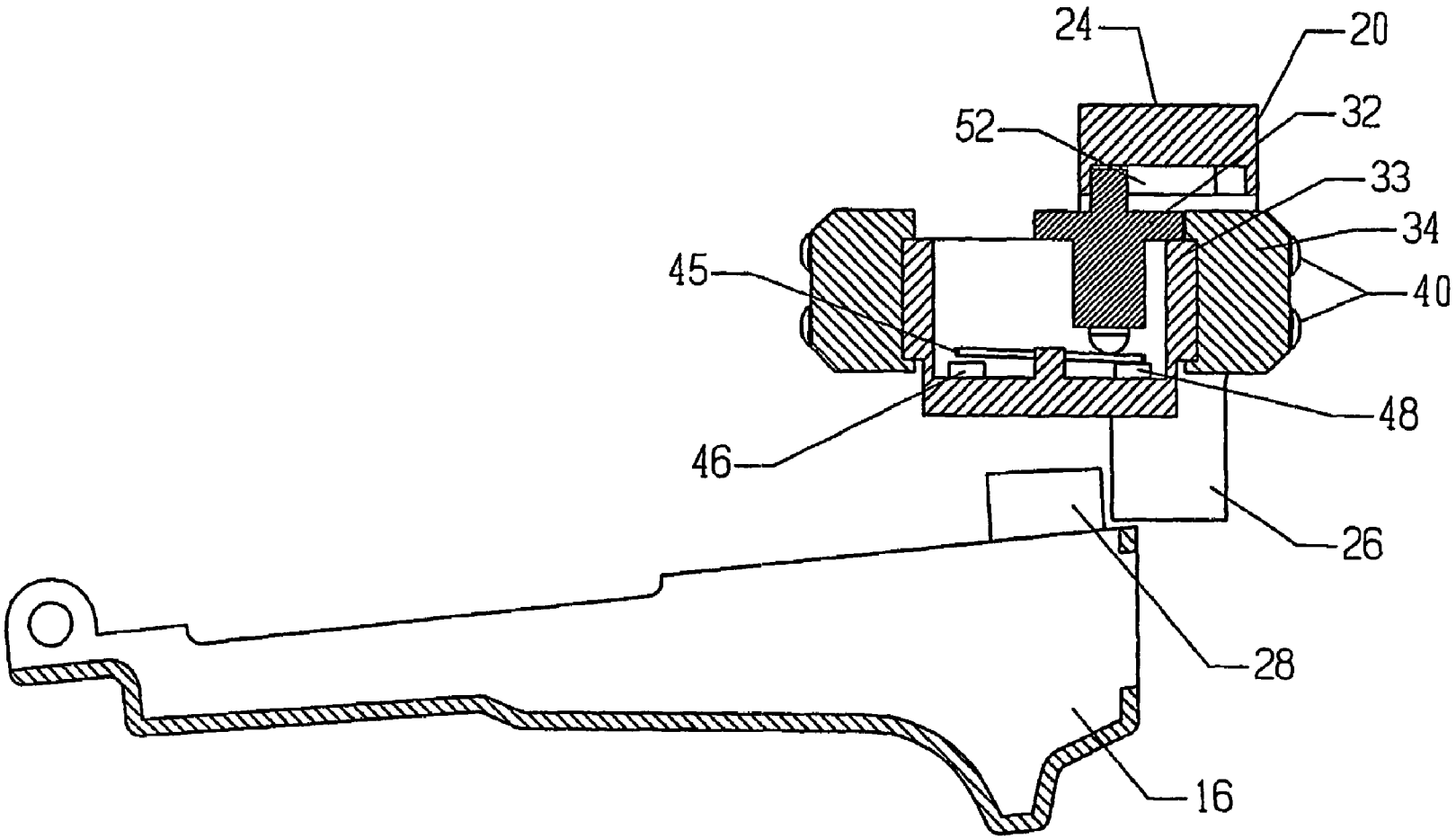
FIG. 4 is a sectional view of the switch mechanism and grinder trigger with the trigger in an operational position and the switch in the FORWARD operational position, taken on line 4—4 of FIG. 3.

When the user slides the thumb slide 24 out of the OFF position, the depending legs 26 are displaced in relation to the dogs 28, allowing depression of the trigger 16. When the user then squeezes trigger 16, the dogs 28 lift up to a position adjacent the depending legs 26, such that the sides of the legs 26 and dogs 28 abut, as shown in FIG. 4. This physically impedes external switch 20 from returning to the OFF position. Upon the release of trigger 16, dogs 28 are also withdrawn downward along with the trigger and hence out of side to side abutment with the legs 26. This allows the switch 20 to then be set to the FORWARD or REVERSE positions. The invention allows the user to release thumb slide 24 once the trigger is depressed. This reduces hand fatigue, as compared to being required to maintain constant pressure on the thumb slide 24.

The external switch 20 according to the preferred embodiment is substantially U-shaped, as best seen in FIG. 3. A switch contact carriage 33 is provided between the depending legs 26, as will be discussed in more detail below. The internal switch mechanism 32 will be discussed in more detail below.

Figure 5:
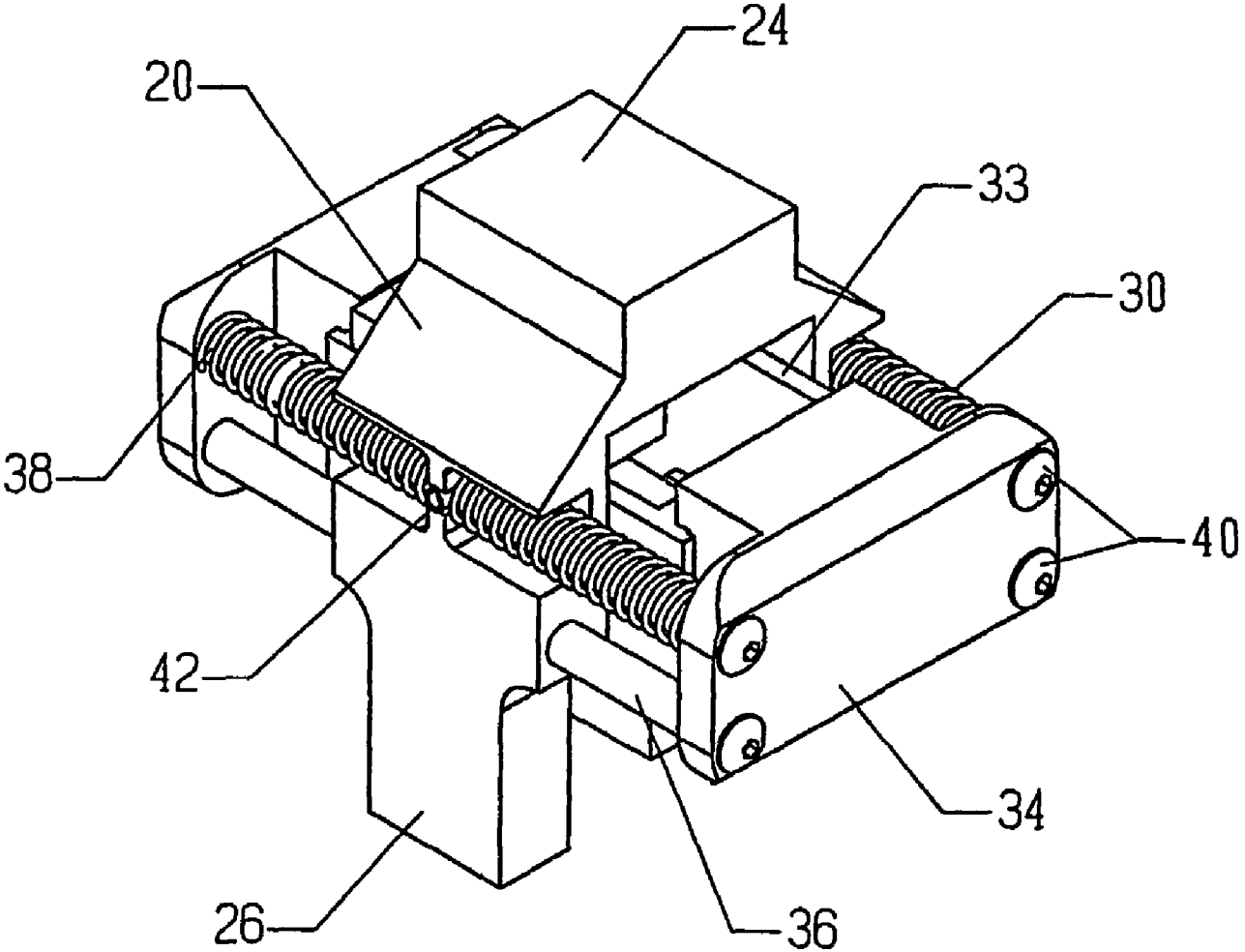
FIG. 5 is an isometric view of the switch mechanism.
Figure 6:
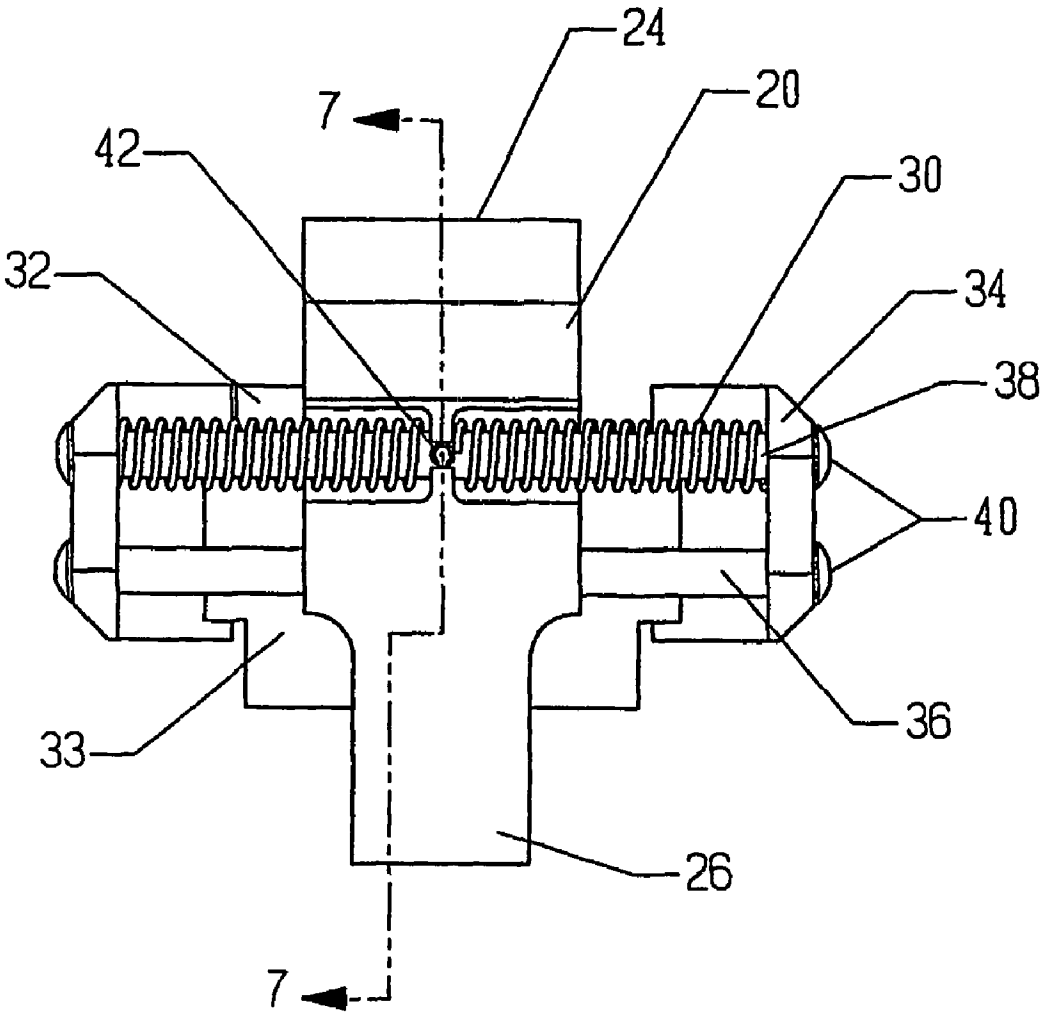
FIG. 6 is a side view of the switch mechanism of FIG. 5.
Figure 7:
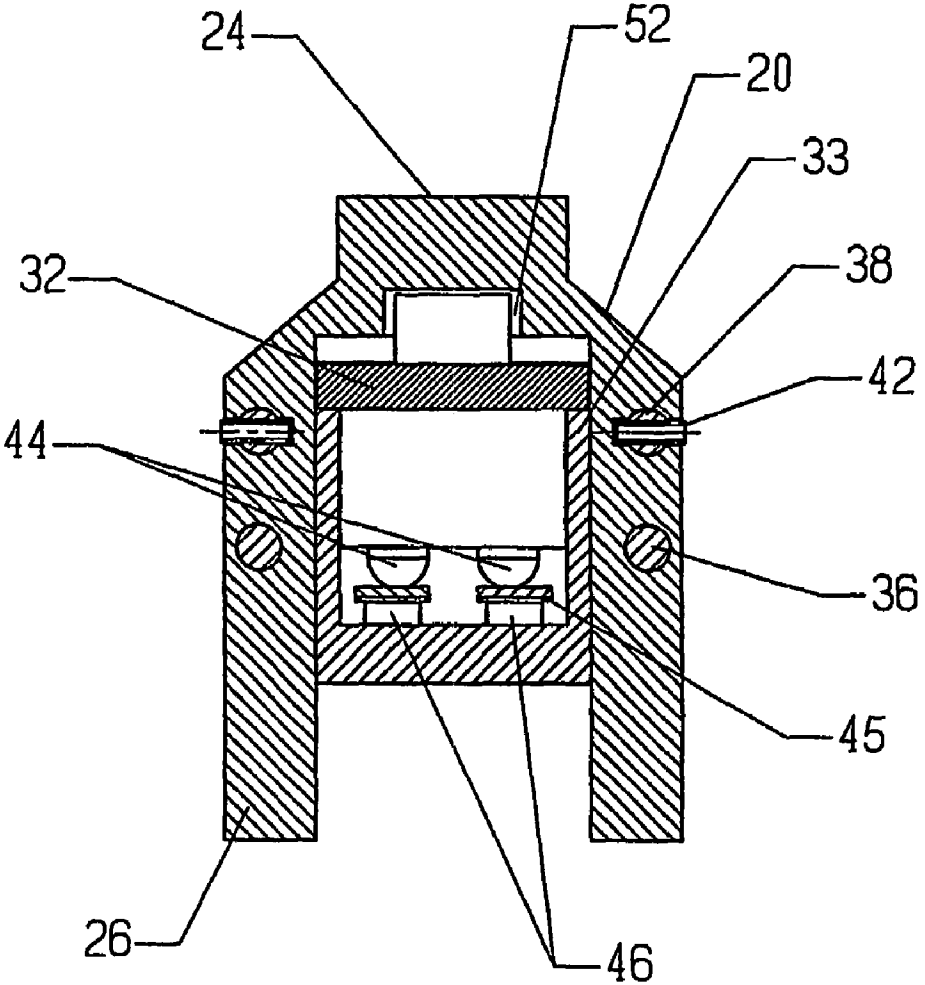
FIG. 7 is a sectional view of the switch mechanism, taken on line 7—7 of FIG. 6.
Figure 8:
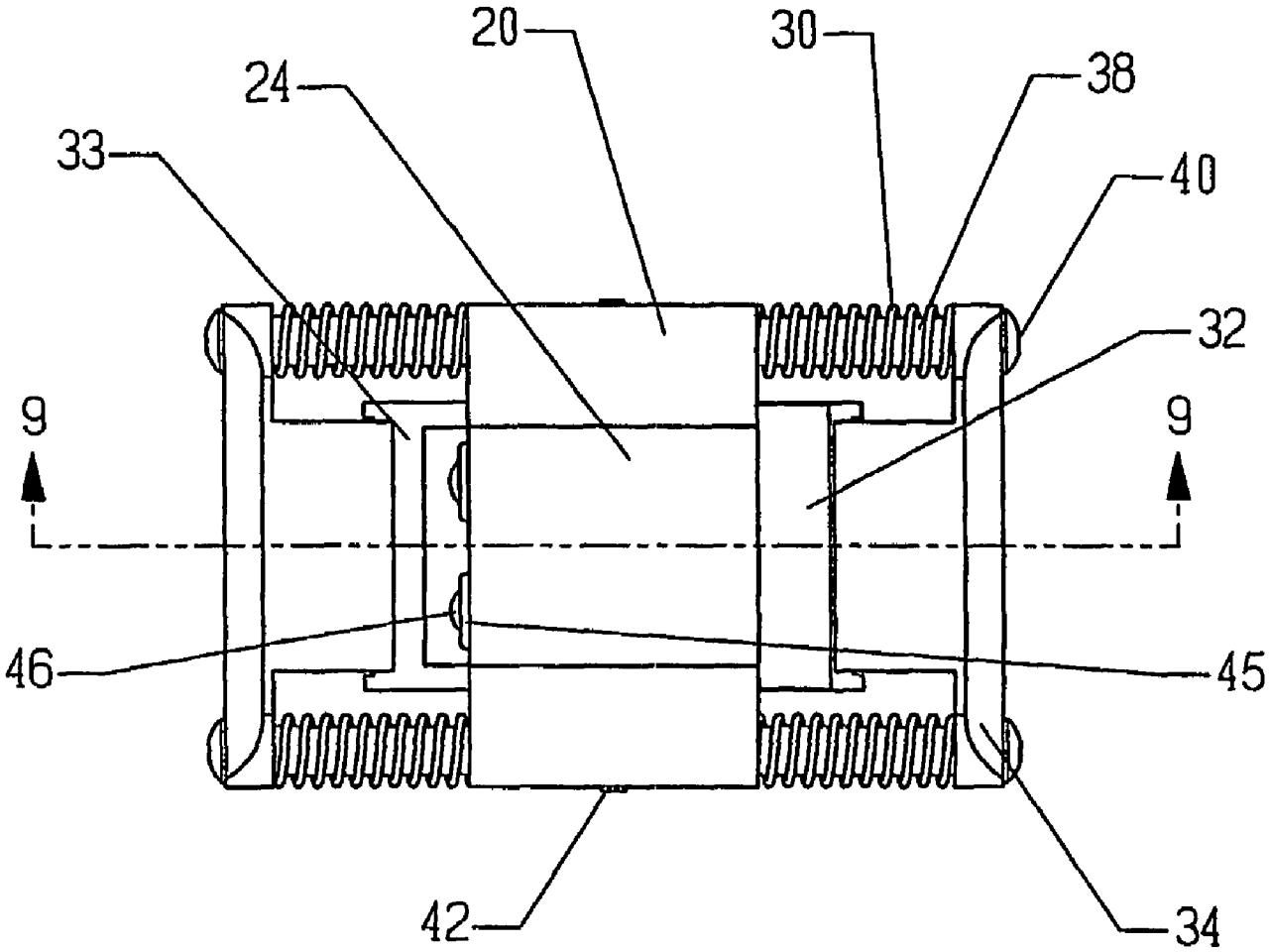
FIG. 8 is a top view of the switch mechanism of FIG. 5.

FIG. 5 shows a more detailed view of the assembly of the external switch 20, including the thumb slide 24 and the depending legs 26. The entire switch mechanism 10 is mounted between two end blocks 34. The exact shape and size of the end blocks 34 will depend on the dimensions of the handle 12. End blocks 34 must fit snugly into the handle 12, such that pressure on the thumb slide 24 will move only the thumb slide 24, not the entire switch mechanism 10. Two pairs of drill rods 36, 38 attached to the end blocks 34 with screws 40, maintain the end blocks 34 in a spaced relationship. The lowermost pair of drill rods 36 extends through the depending legs 26, providing a guideway along which the external switch 20 may slide. The uppermost pair of drill rods 38 supports the two pairs of compression springs 30, maintaining the springs 30 in proper alignment and position relative to the external switch 20. The compression springs 30 and upper drill rods 38 extend through the external switch 20. A roll pin 42 may be used to attach both of the spring 30 ends to the centre of each side of the external switch 20, as best seen in FIGS. 6 through 8. The roll pins 42, or any comparable fastening mechanism, ensure the entire external switch 20 is centred properly, such that the switch 20, in the absence of external pressure, is securely spring-biased to remain in the centre, OFF position.

FIG. 7 illustrates the attachment of roll pins 42, as well as the two pairs of drill rods 36, 38 extending through the depending legs 26. In the preferred embodiment, the external switch 20 must travel approximately half an inch to operate the grinder 14 in the REVERSE or FORWARD directions. This is sufficient to ensure that the grinder 14 will not operate unless the user intends to do so, and not if the user accidentally bumps the handle 12 or thumb slide 24. The springs 30 are selected to allow easy movement of the thumb slide 24 by the user, while still providing a bias to the switch to the OFF position.

FIG. 7 shows switch carriage 33, containing two contacts 44 of the internal switch 32 and two REVERSE contacts 46 for the grinder motor. FIG. 8 shows a top view of the switch mechanism, including the pair of REVERSE motor contacts 46 and the ends of the pair of rocker contacts 45 (only one of each of which is labelled in FIG. 8).

Figure 9:
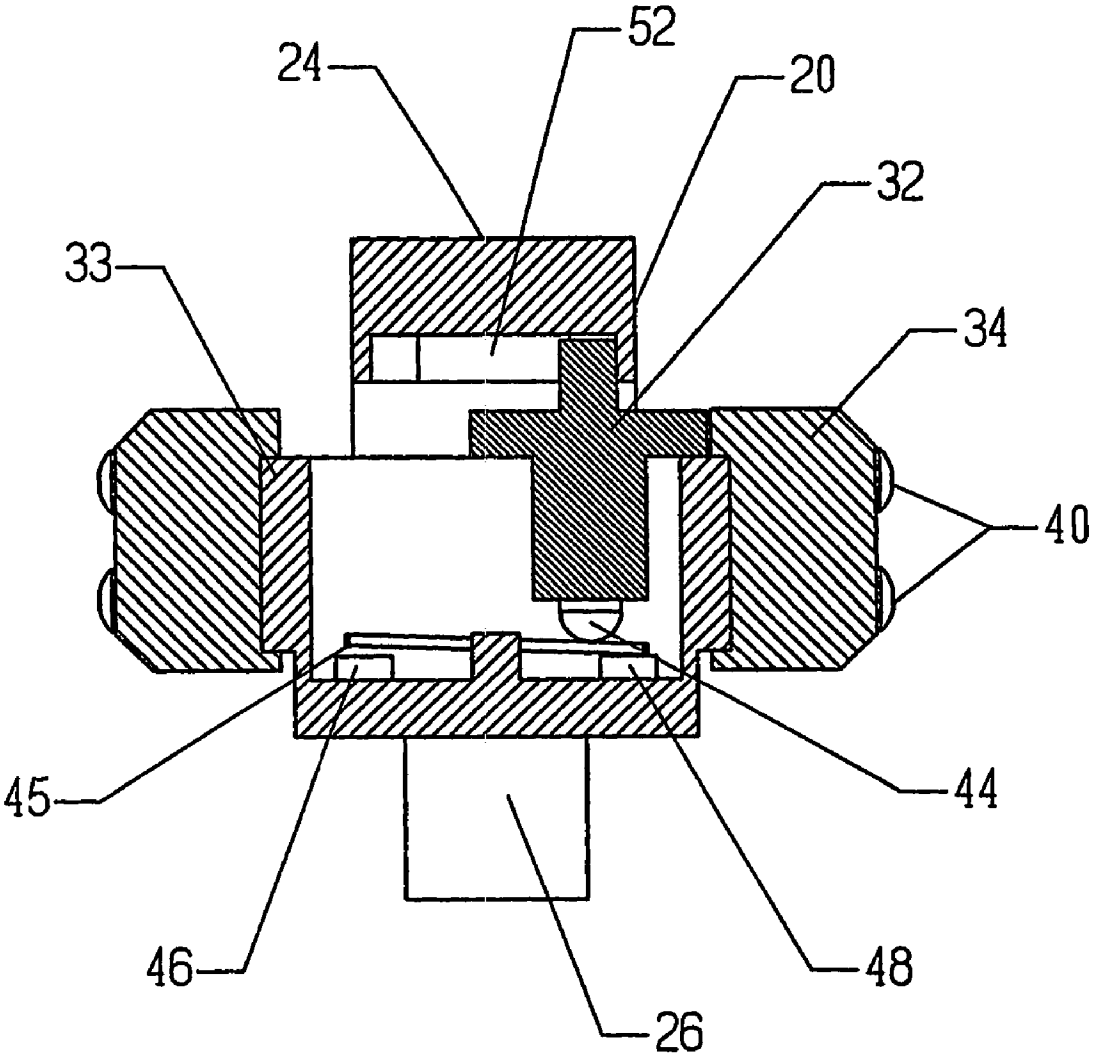
FIG. 9 is a sectional view of the switch mechanism, taken on line 9—9 of FIG. 8.

FIG. 9 shows the side view of one embodiment of the switch mechanism 10, including one contact 44 of the internal switch 32, one rocker contact 45, one REVERSE direction contact 46 of the grinder motor and one FORWARD direction contact 48 of the motor. For ease of explanation, the REVERSE direction contact 46 is specified as being on the left side of FIG. 9, while the FORWARD direction contact 48 is on the right. The internal switch 32 slides from left to right, corresponding to the user's thumb pressure on the thumb slide 24. The internal switch contacts 44 thus connect with rocker contacts 45, pushing the ends of rocker contacts 45 into contact with one set of motor contacts 50 at a time. When the internal switch contacts 44 are in contact with either set of motor contacts 50, a circuit through the series-wound grinder motor 51 is completed. This circuit remains unbroken, even if the trigger 16 is released, until the user slides the thumb switch in the opposite direction. When the thumb slide 24 is displaced in either the FORWARD or REVERSE direction, and the trigger 16 is depressed, power flows from the power source to operate the grinder 14 in the appropriate direction.

The thumb slide 24 of the external switch 20 is also shown in FIG. 9, including an inner cavity 52 underneath the thumb slide 24. The dimensions of the inner cavity 52 are determined such that the external switch 20, once released, will move back to its centre, OFF position without moving the internal switch contacts 44 away from the motor contacts 46, 48. In this position, the legs 26 depending from the thumb slide 24 abut the dogs 28 extending from the trigger 16, providing an interlocking safety mechanism to ensure that trigger 16 can not be accidentally depressed. Further, the circuit path established by the internal switch 32 remains intact through the auxiliary windings 56 to operate the dynamic braking system. Thus, the OFF position of the external switch 20 is actually a "false neutral." This "false neutral" position makes this switch mechanism 10 particularly suitable for reversible power tools with dynamic braking systems.

Figure 10:
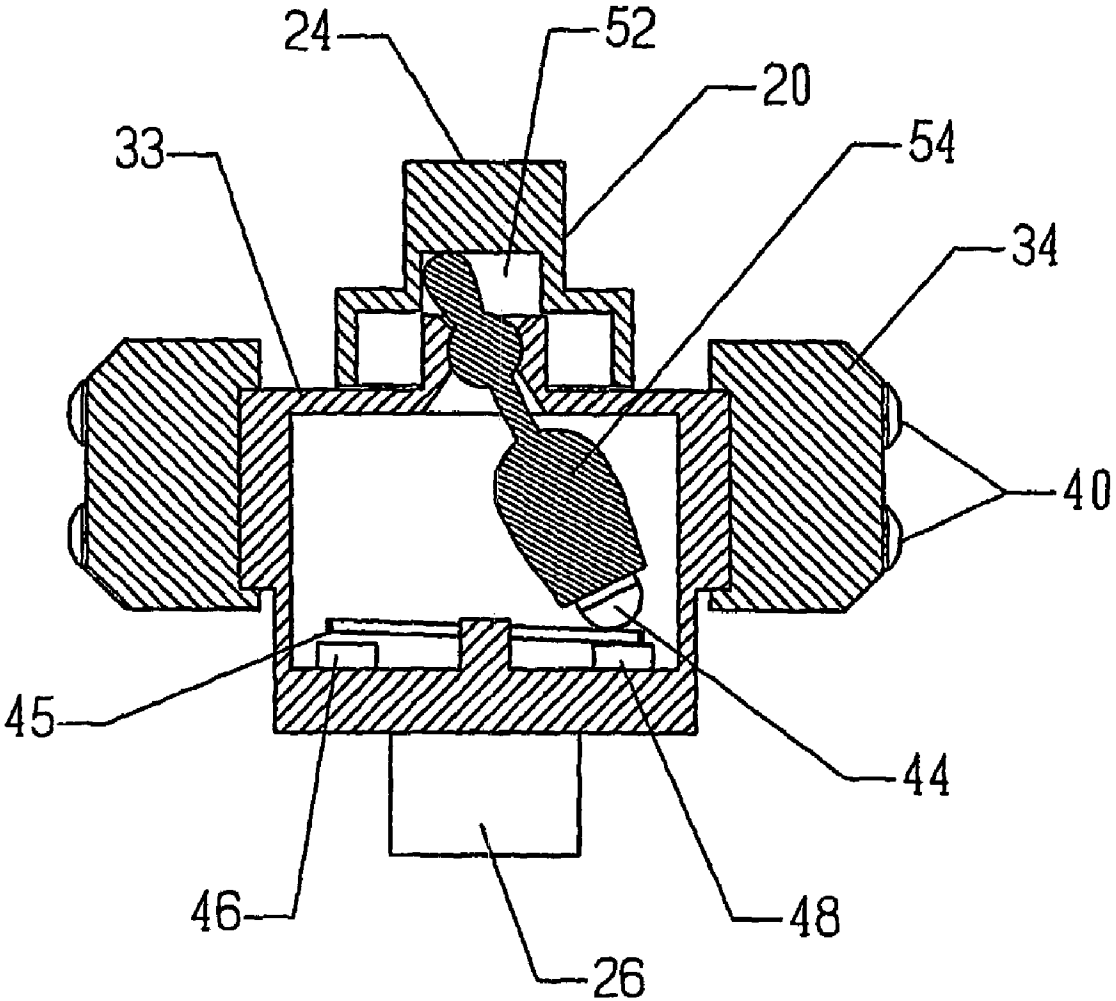
FIG. 10 is an alternate embodiment of the internal switch mechanism of FIG. 9; and, FIG. 11 is a schematic of the circuit in the preferred embodiment of the invention.

An alternate embodiment of the internal switch contacts 44 is shown in FIG. 10. The external thumb slide 24 and depending legs 26 are the same as those in FIG. 9, as are the directional motor contacts 48, 49 and rocker contacts 45. However, internal switch 32 has been replaced by toggle switch 54, which contains internal switch contacts 44. The toggle switch arrangement provides the user with a more obvious indication of when the operational direction of the switch changes, as the toggle switch 54 snaps from one direction to the other. Using toggle switch 54 may also provide a better seal against dirt entering the switch mechanism than the internal slide switch shown in FIG. 9. The external thumb slide 24 still contains inner cavity 52 of sufficient size to allow a "false neutral" switch position.

A specific example of the "false neutral" arrangement is shown in FIG. 9. In FIG. 9, the thumb slide 24 has returned to the apparent OFF or neutral position, but the internal switch contacts 44 remain connected to the rightmost (FORWARD direction) motor contacts 48 via rocker contacts 45. If the user still wants to operate the grinder 14 in the FORWARD direction, he will slide the thumb slide 24 to the left, releasing the depending legs 26 from contact with the trigger dogs 28, then squeeze the trigger 16 (not shown). In order to change the direction of operation of the grinder, the user would slide the thumb slide 24 to the extreme left. This would change the internal switch connection such that the internal switch contacts 44 are connected, via rocker contacts 45, to the REVERSE direction motor contacts 46. When the user squeezes the trigger 16, the grinder 14 would then operate in the REVERSE direction. When the thumb slide 24 is fully pressed in either direction, the dogs 28 on the trigger 16 (not shown in FIG. 9) abut the side of the depending legs 26, such that the user no longer has to hold the thumb slide 24 as long as the trigger 16 is depressed. As soon as the user releases the trigger 16, the thumb slide 24 will return to the neutral position, the depending legs 26 will physically lock off the trigger 16, and the dynamic brake will engage.

The switch mechanism described above ensures that current flow through the series-wound motor 51 windings is never interrupted unless the user is actively taking steps to change the direction of grinder operation. This arrangement guarantees that the dynamic braking circuit through the auxiliary windings 56 is always complete when the grinder is not actually being used. Further, the switch mechanism provides a second safety feature, namely an interlocking effect between the trigger 16 and the switch 10 to prevent accidental depression of the switch. The physical interlock also allows the user to release the switch 10 once the grinder 14 is operating in the proper direction, reducing hand fatigue.

It will be appreciated by those skilled in the art that other variations to the preferred embodiment described herein may be practised without departing from the scope of the invention, such scope being properly defined by the following claims.

The invention claimed is:

1. A switch mechanism for use in a power tool having a motor, a handle and at least two operable directions comprising:

a first switch movable between an ON position and an OFF position to selectively actuate said motor;

a second switch to select between said directions, said second switch further comprising a neutral position in which neither of said directions is selected, said second switch being positioned across said handle in opposed relation to said first switch;

a first abutment extending from said first switch;

a second abutment extending from said second switch;

said first and second abutments extending generally toward one another in generally opposed, parallel relationship, said second abutment being displaceable by movement of said second switch between a first position in which said first and second abutments are in end to end contact when said second switch is in said neutral position, and second and third positions in which said first and second abutments are in side to side contact when said second switch is in a position other than said neutral position;

said end to end contact preventing displacement of said first switch to said ON position until said second switch is displaced to a position other than said neutral position; and, said side to side contact preventing displacement of said second switch to said neutral position until said first switch is displaced to said OFF position.

2. The switch mechanism of claim 1 wherein said second switch comprises:

an approximately inverted-U-shaped external sliding switch;

a cavity on the uppermost underside of the external sliding switch; and an internal switch.

3. The switch mechanism of claim 2 wherein said internal switch is an approximately t-shaped sliding switch.

4. The switch mechanism of claim 2 wherein said internal switch is a toggle switch.

5. The switch mechanism of claim 1 wherein said first switch is a trigger.

6. The switch mechanism of claim 3 or 4 further comprising means to bias the external sliding switch to a centred position, said centred position corresponding to said neutral second switch position.

7. The switch mechanism of claim 6 wherein said means to bias the external sliding switch comprises one or more springs.

8. The switch mechanism of claim 7 wherein said springs are maintained in place by a connection to the external sliding switch.

9. The switch mechanism of claim 8 wherein said connection is made using one or more roll pins.

10. The switch mechanism of claim 1 further comprising a mounting mechanism to secure the switch mechanism in place, wherein said mounting mechanism comprises:

end blocks of a shape and size to snugly fit into the handle of the power tool; and one or more pairs of rods separating the end blocks.

11. The switch mechanism of claim 1 wherein said motor is a series-wound motor.

12. The switch mechanism of claim 1 further comprising a dynamic brake wherein said dynamic brake is engaged when said second switch is in said neutral position.

13. The switch mechanism of claim 12 further comprising at least one pair of motor contacts to allow operation of the tool in each of the operable directions.

14. The switch mechanism of claim 13 wherein said second switch comprises:

an approximately inverted-U-shaped external sliding switch;

a cavity on the uppermost underside of the external sliding switch;

an internal switch;

electrical contacts extending from the lowermost surface of the internal sliding switch; and one or more rocker contacts serving to connect the electrical contacts extending from the internal sliding switch to the motor contacts.

15. The switch mechanism of claim 14 wherein an electric current path runs through said motor, said motor contacts, said rocker contacts and said electrical contacts when said first switch is in said ON position and said second switch is positioned to select one of said operable directions.

16. The switch mechanism of claim 14 wherein an electric current path runs through said motor, said motor contacts, said rocker contacts, said electrical contacts and said dynamic brake when said first switch is in said OFF position and said second switch is in said neutral position.

17. The switch mechanism of claim 16 wherein said motor is a series-wound motor.

18. The switch mechanism of claim 17 wherein said dynamic brake comprises auxiliary windings in series with said series-wound motor.

19. The switch mechanism of claim 18 wherein said internal switch is an approximately t-shaped sliding switch.

20. The switch mechanism of claim 18 wherein said internal switch is a toggle switch.

21. The switch mechanism of claim 14 wherein said first switch is a trigger.

22. The switch mechanism of claim 19 or 20 further comprising means to bias the external sliding switch to a centred position, said centred position corresponding to said neutral second switch position.

23. The switch mechanism of claim 22 wherein said means to bias the external sliding switch comprises one or more springs.

24. The switch mechanism of claim 23 wherein said springs are maintained in place by a connection to the external sliding switch.

25. The switch mechanism of claim 24 wherein said connection is made using one or more roll pins.

26. A switch mechanism for use in a power tool with a motor and a dynamic brake and at least two operable directions comprising:

a first switch having an ON and an OFF position to selectively actuate said motor and a first abutment;

a second switch to select between said directions, said second switch further comprising a second abutment and having a neutral position in which said dynamic brake is engaged;

said switches being constrained such that said first switch can move to said ON position only when said second switch is not in said neutral position and said second switch can move to said neutral position only when said first switch is in said OFF position;

wherein said switches are constrained by physical contact between said abutments.

27. The switch mechanism of claim 26 further comprising at least one pair of motor contacts to allow operation of the tool in each of the operable directions.

28. The switch mechanism of claim 27 wherein said second switch comprises:

an approximately inverted-U-shaped external sliding switch;

a cavity on the uppermost underside of the external sliding switch;

an internal switch;

electrical contacts extending from the lowermost surface of the internal sliding switch; and one or more rocker contacts serving to connect the electrical contacts extending from the internal sliding switch to the motor contacts.

29. The switch mechanism of claim 28 wherein an electric current path runs though said motor, said motor contacts, said rocker contacts and said electrical contacts when said first switch is in said ON position and said second switch is positioned to select one of said operable directions.

30. The switch mechanism of claim 29 wherein an electric current path runs though said motor, said motor contacts, said rocker contacts, said electrical contacts and said dynamic brake when said first switch is in said OFF position and said second switch is in said neutral position.

31. The switch mechanism of claim 30 wherein said motor is a series-wound motor.

32. The switch mechanism of claim 31 wherein said dynamic brake comprises auxiliary windings in series with said series-wound motor.

33. The switch mechanism of claim 32 wherein said internal switch is an approximately t-shaped sliding switch.

34. The switch mechanism of claim 32 wherein said internal switch is a toggle switch.

35. The switch mechanism of claim 32 wherein said first switch is a trigger.

36. The switch mechanism of claim 33 or 34 further comprising means to bias the external sliding switch to a centred position, said centred position corresponding to said neutral second switch position.

37. The switch mechanism of claim 36 wherein said means to bias the external sliding switch comprises one or more springs.

38. The switch mechanism of claim 37 wherein said springs are maintained in place by a connection to the external sliding switch.

39. The switch mechanism of claim 38 wherein said connection is made using one or more roll pins.

40. The switch mechanism of claim 26 further comprising a mounting mechanism to secure the switch mechanism in place, wherein said mounting mechanism comprises:

end blocks of a shape and size to snugly fit into the handle of the power tool; and one or more pairs of rods separating the end blocks.

* * * * *